US008668538B1

(12) United States Patent
Langenfeld et al.

(10) Patent No.: US 8,668,538 B1
(45) Date of Patent: Mar. 11, 2014

(54) MARINE ENGINES AND EXHAUST SYSTEMS FOR MARINE ENGINES HAVING A CATALYST FOR TREATING EXHAUST

(75) Inventors: Gregg D. Langenfeld, Fond du Lac, WI (US); David W. Heidel, Green Lake, WI (US); David J. Belter, Oshkosh, WI (US); Jeffrey J. Broman, Slinger, WI (US); Timothy S. Reid, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 205 days.

(21) Appl. No.: 13/306,700

(22) Filed: Nov. 29, 2011

(51) Int. Cl.
*B63H 21/34* (2006.01)

(52) U.S. Cl.
USPC ..... 440/89 H

(58) Field of Classification Search
USPC ..... 440/89 H
See application file for complete search history.

(56) References Cited

U.S. PATENT DOCUMENTS

| | | | | |
|---|---|---|---|---|
| 4,932,367 | A | 6/1990 | Newman et al. | |
| 5,346,417 | A * | 9/1994 | Isogawa | 440/89 R |
| 5,822,985 | A | 10/1998 | Yoshimura | |
| 5,911,608 | A | 6/1999 | Nakayama et al. | |
| 6,622,481 | B1 * | 9/2003 | Ruman et al. | 60/298 |
| 7,954,314 | B1 | 6/2011 | Bruestle et al. | |
| 8,366,501 | B2 | 2/2013 | Kazuta | |
| 2009/0078240 | A1 * | 3/2009 | Diggs et al. | 123/559.1 |
| 2010/0130079 | A1 | 5/2010 | White et al. | |

* cited by examiner

*Primary Examiner* — Stephen Avila
(74) *Attorney, Agent, or Firm* — Andrus Intellectual Property Law, LLP

(57) ABSTRACT

A marine engine has an exhaust system comprising a cylinder block comprising first and second banks of cylinders that are disposed along a longitudinal axis and that extend transversely with respect to each other in a V-shape so as to define a valley there between. A catalyst receptacle is disposed in the valley and contains at least one catalyst that treats exhaust gas from the marine engine. An exhaust manifold conveys exhaust gas from the marine engine to the catalyst receptacle. The exhaust manifold has a first port receiving exhaust gas from the first bank of cylinders, a second port receiving exhaust gas from the second bank of cylinders, and a conduit conveying the exhaust gas from the first and second ports to the catalyst receptacle, wherein from the first and second ports to the catalyst receptacle, the conduit only reverses direction once with respect to the longitudinal axis.

22 Claims, 7 Drawing Sheets

MARINE ENGINES AND EXHAUST SYSTEMS FOR MARINE ENGINES HAVING A CATALYST FOR TREATING EXHAUST

FIELD

The present disclosure relates to marine engines and exhaust systems for marine engines, and particularly to V-style marine engines having one or more catalysts for treating exhaust gas.

BACKGROUND

U.S. Pat. No. 4,932,367; which is hereby incorporated herein in entirety by reference; discloses a V-type four-stroke cycle internal combustion engine having an exhaust manifold and an air intake manifold disposed in the valley of the V-engine. The exhaust from the cylinders passes through exhaust passages formed in the cylinder heads which discharge exhaust into the valley of the V-engine for collection in a central exhaust cavity provided in the exhaust manifold. A single exhaust discharge outlet is in communication with the central exhaust cavity for discharging exhaust therefrom.

U.S. Pat. No. 6,622,481; which is hereby incorporated herein in entirety by reference; discloses an exhaust treatment device for an internal combustion engine of a marine propulsion system. An outer chamber contains a first inner chamber within it and slidably supports the inner chamber. An exhaust inlet conduit directs a stream of exhaust gas from a cylinder of the internal combustion engine directly into the inner chamber. The inner and outer chambers are supported relative to each other to allow relative movement of these two components in response to changes in the differential temperature between the two components. A rail system slideably supports the inner chamber relative to the outer chamber. The exhaust treatment device comprises a liquid cooled housing surrounding the inner and outer chambers. Exhaust gas is directed through the inner chamber and then into the outer chamber at a closed end of the exhaust treatment device. Exhaust gas then flow through the outer chamber to an exhaust conduit of the marine propulsion system.

U.S. Pat. No. 7,954,314; which is hereby incorporated herein in entirety by reference; discloses an engine having a cavity so that a catalyst member can be contained within the engine when an engine head portion is attached to an engine block portion. This attachment of the engine head portion and engine block portion, which forms the engine structure, captivates the catalyst member within the cavity without the need for additional brackets and housing structures. The cavity is preferably located above or at the upper regions of first and second exhaust conduits which direct exhaust upwardly from the engine head portion toward the cavity and downwardly from the cavity within the engine block portion. The first and second exhaust conduits are preferably formed as integral structures within the engine head portion and engine block portion.

SUMMARY

This disclosure is the product of the present inventors' research and development of exhaust systems for marine engines, and particularly four-stroke V-style marine engines. During such research and development, the inventors recognized that exhaust back-pressure (i.e. pressure in the manifold of the exhaust system) limits the available power of the engine. Back-pressure is typically governed by the pressure drop from the exhaust valve to the atmosphere. The inventors also recognized that adding a catalyst to the exhaust stream adds more back-pressure than is desirable and results in further loss of power. Further, the inventors recognized that bends in exhaust pipes create higher pressure drop than straight sections and hence higher back-pressure. The pressure drop through a bend has also been found to be higher if the bend is sharp and/or if the angle of the bend is higher. However, because of packaging constraints, bends typically need to be sharp or else they will take up too much space under the cowl.

This disclosure provides examples of the inventors' solutions to these problems. In one example, a marine engine has an exhaust system comprising a cylinder block having first and second banks of cylinders that are disposed along a longitudinal axis and extend transversely with respect to each other in a V-shape so as to define a valley there between. A catalyst receptacle is disposed in the valley and contains at least one catalyst that treats exhaust gas from the marine engine. An exhaust manifold conveys exhaust gas from the marine engine to the catalyst receptacle. The exhaust manifold has a first port receiving exhaust gas from the first bank of cylinders, a second port receiving exhaust gas from the second bank of cylinders, and a conduit conveying the exhaust gas from the first and second ports to the catalyst receptacle, wherein from the first and second ports to the catalyst receptacle, the conduit only reverses direction once with respect to the longitudinal axis.

DETAILED DESCRIPTION OF THE DRAWINGS

In the present disclosure, certain terms have been used for brevity, clearness and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Figure 1:
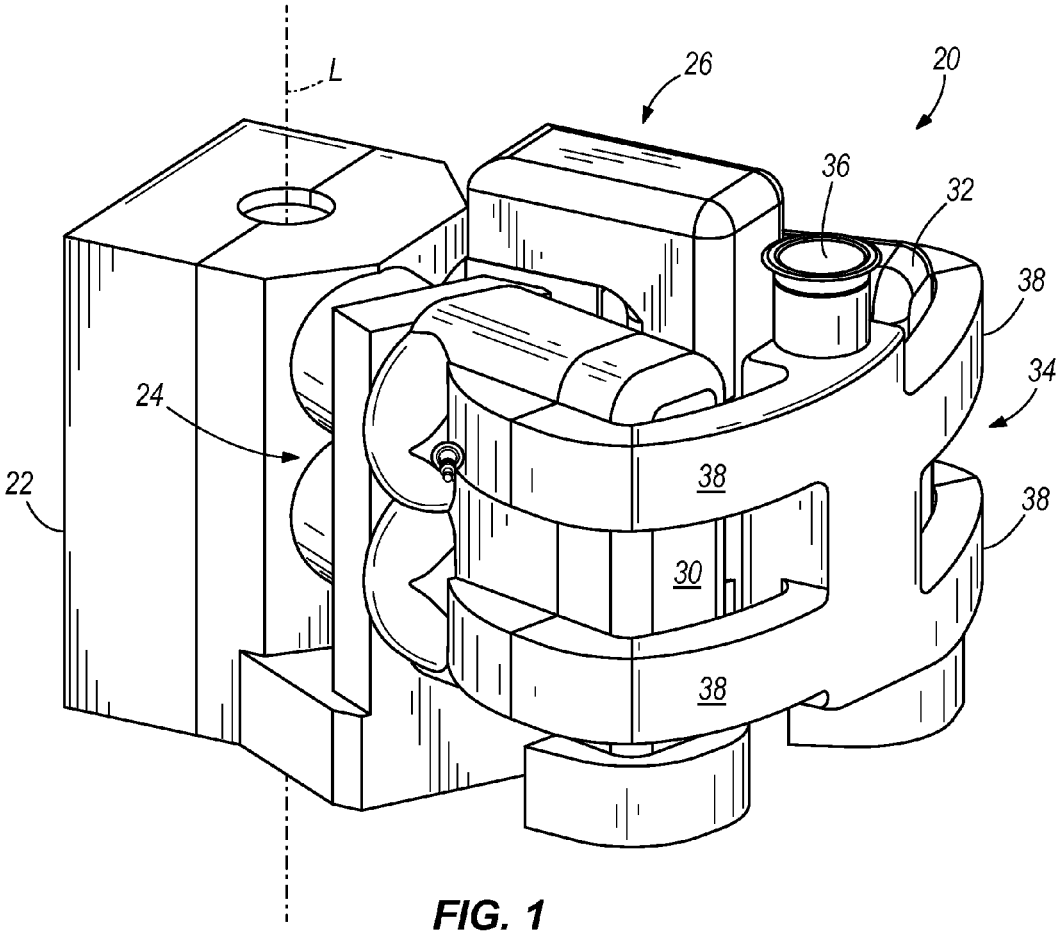
FIG. 1 is a perspective view of a four cylinder, four stroke, V-style internal combustion engine for a marine drive.

FIG. 1 depicts a marine engine 20, which in the example shown is a four cylinder, four stroke, V-style engine for an outboard motor. It should be noted however that while the examples that are shown and described herein are four cylinder, four stroke, V-style marine engines, the concepts of the present disclosure are also fully applicable to six and eight cylinder V-style marine engines in outboard, inboard and inboard/outboard marine engine configurations. In FIG. 1, the marine engine 20 includes a cylinder block 22 on which first and second banks of cylinders 24, 26 are aligned with respect to a longitudinal axis L and extend transversely with respect to each other in a V-shape so as to define a valley 28 (see FIGS. 2 and 3) there between. First and second cylinder heads 30, 32 are located on the first and second banks of aligned cylinders 24, 26, respectfully. An intake manifold 34 is also shown in FIG. 1. The intake manifold 34 receives intake air via inlet port 36 and conveys the intake air to the respective first and second banks of aligned cylinders 24, 26 for the combustion process. In the example shown, an intake air passageway 38 is provided for each cylinder in the first and second banks of aligned cylinders 24, 26. Other configurations of the intake manifold 34 can be employed and the example shown is not intended to be limiting on the present disclosure. As is conventional, intake air supplied via the intake manifold 34 is utilized during the combustion process in the marine engine 20.

Figure 3:
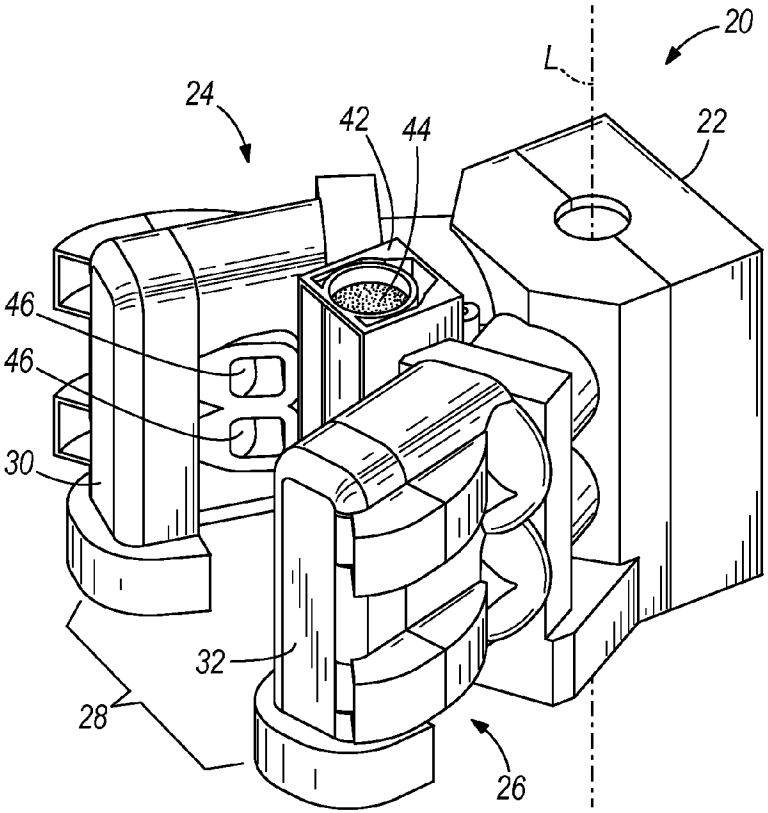
FIG. 3 is a view like FIG. 2, wherein the exhaust manifold is removed and showing a catalyst receptacle disposed in the valley defined by the cylinders of the engine.
Figure 2:
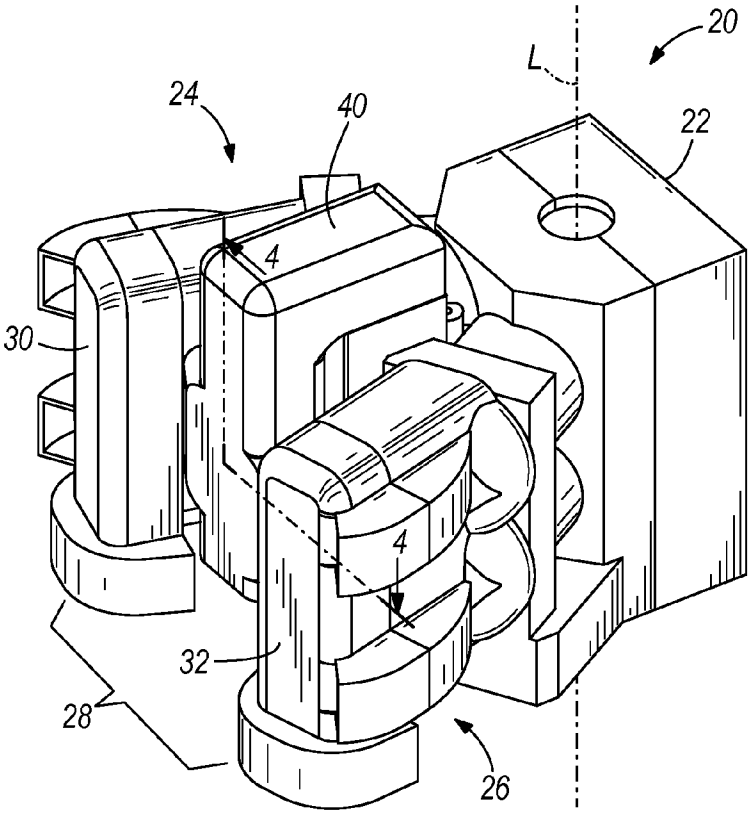
FIG. 2 is a view like FIG. 1, wherein the intake manifold of the engine is removed.

FIGS. 2 and 3 depict the marine engine 20 without the intake manifold 34. An exhaust manifold 40 conveys exhaust gas from the first and second cylinder heads 30, 32 to a catalyst receptacle 42 disposed in the valley 28. In this example, the exhaust manifold 40 is disposed in the valley 28 and receives exhaust gas from the first and second banks of aligned cylinders 24, 26 via the first and second cylinder heads 30, 32. FIG. 3 depicts the marine engine 20 having the exhaust manifold 40 removed and shows the catalyst receptacle 42 containing at least one catalyst 44 that treats exhaust gas from the first and second banks of cylinders 24, 26. The catalyst receptacle 42 has an inner cylindrical shape; however other shapes and sizes of catalyst receptacles can be employed. Optionally, the catalyst receptacle 42 can be cast in to the cylinder block 22.

Figure 4:
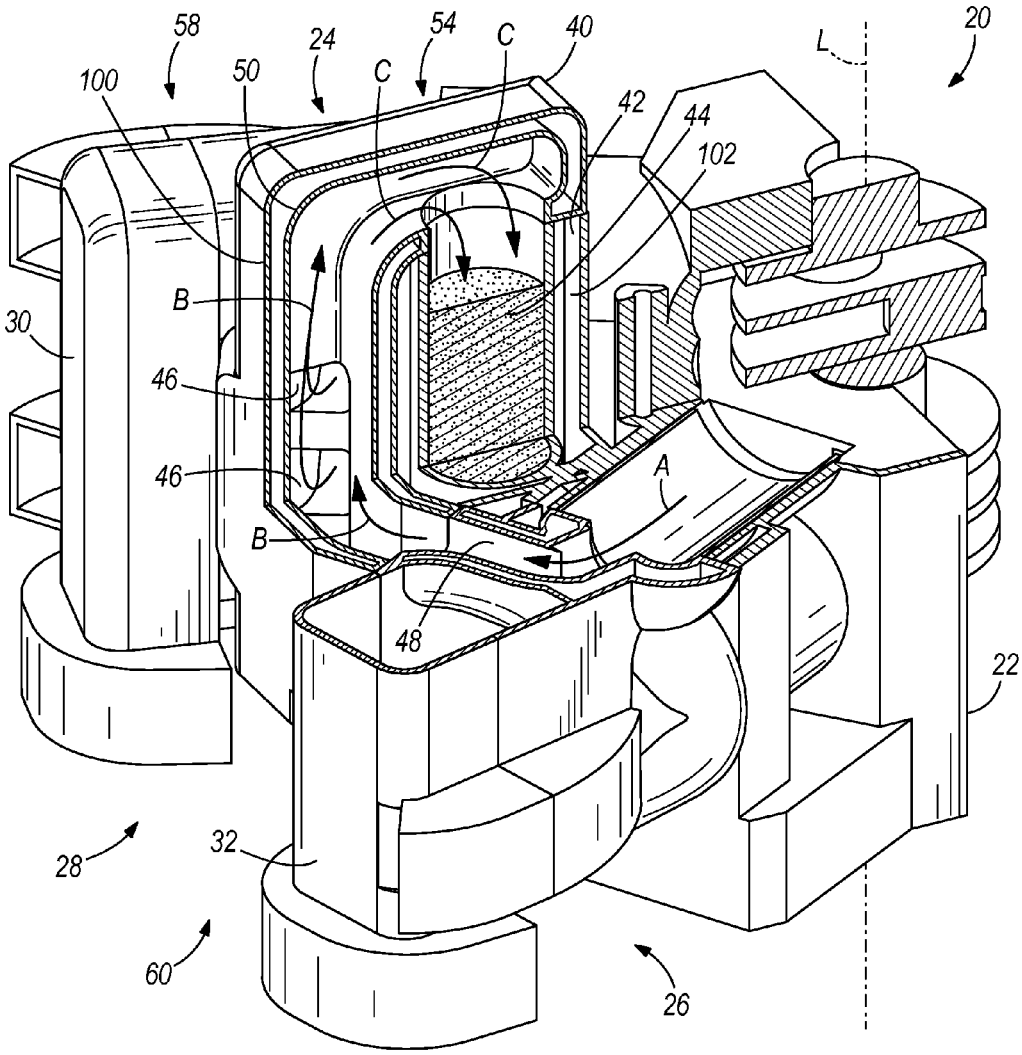
FIG. 4 is a view of section 4-4 taken in FIG. 2.

FIG. 4 depicts the marine engine 20 at section 4-4 taken in FIG. 2. The exhaust manifold 40 has first ports 46 receiving exhaust gas from the first cylinder head 30, second ports 48 receiving exhaust gas from the second cylinder head 32, and a conduit 50 conveying the exhaust gas from the first and second ports 46, 48 to the catalyst receptacle 42. The number of ports can vary from that which is shown and described. In the example shown, exhaust ports 46, 48 are provided for each cylinder in the first and second banks of cylinders 24, 26, respectively. FIG. 4 shows two ports 46 and one port 48. In this example, a second port 48, which is not shown in this view, is also provided for the second bank of aligned cylinders 26. The first ports 46 and second ports 48 are inwardly oriented towards the valley 28 and the exhaust manifold 40 is configured to receive and mix exhaust gas from both of the first and second ports 46, 48 in the conduit 50. In this configuration, the exhaust manifold 40 extends out from the end of the valley 28 and then back into the valley 28 at a bend 54, which in the example shown is a 180 degree bend. Exhaust gas is conveyed through the bend 54 to the catalyst receptacle 42 wherein the exhaust gas is treated by catalyst 44. In this configuration, from the first and second ports 46, 48, the conduit 50 only reverses direction once with respect to the longitudinal axis L, which reversal is provided by the 180 degree bend.

As can be seen from FIG. 4, the valley 28 has first and second opposite (in this example, top and bottom) ends 58, 60. In this example, the exhaust manifold 40 extends out from and back into only one of the first and second ends 58, 60, namely the first end 58 in this example. Exhaust gas thus flows transversely at arrows A from the first and second banks of aligned cylinders 24, 26 through the first and second ports 46, 48. Once into the exhaust manifold 40, exhaust gas flows transversely with respect to the first and second ports 46, 48, out of the first end 58 of the valley 28 and through the conduit 50 at arrow B. Once reversing direction through the bend 54 at arrow C, exhaust gas flows back into the first end 58 of the valley 28 and into the catalyst receptacle 42 for treatment by the catalyst 44. After flowing through the catalyst 44, exhaust gas exits the catalyst receptacle 42 via the second end 60 of the valley 28 for disposal from the propulsion system via conventional means.

A cooling jacket 100 can be provided around the exhaust manifold 34. Cooling fluid (not shown), such as water drawn from the body of water in which the vessel is operating can be pumped through the cooling jacket in a conventional manner to maintain the exhaust gas at a preferred temperature. A cooling jacket 102 can also be provided on the catalyst receptacle 42 to maintain the catalyst at a preferred temperature.

The exhaust system shown in FIGS. 1-4 has been found by the present inventors to provide significant packaging and cost advantages and provides an arrangement that meets space constraints and minimizes weight. By routing the exhaust gas through only a single bend 54 in the exhaust manifold 40 pressure drop is decreased and thus efficiency of the marine engine 20 is advantageously increased.

Figure 5:
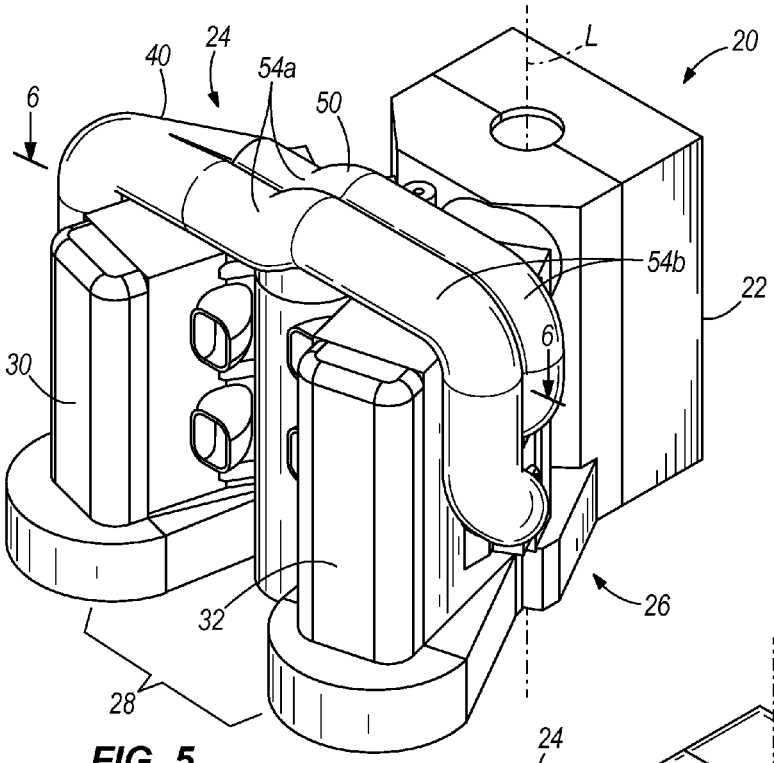
FIG. 5 is a perspective view of another example of a four cylinder, four stroke, V-style internal combustion engine for a marine drive.
Figure 6:
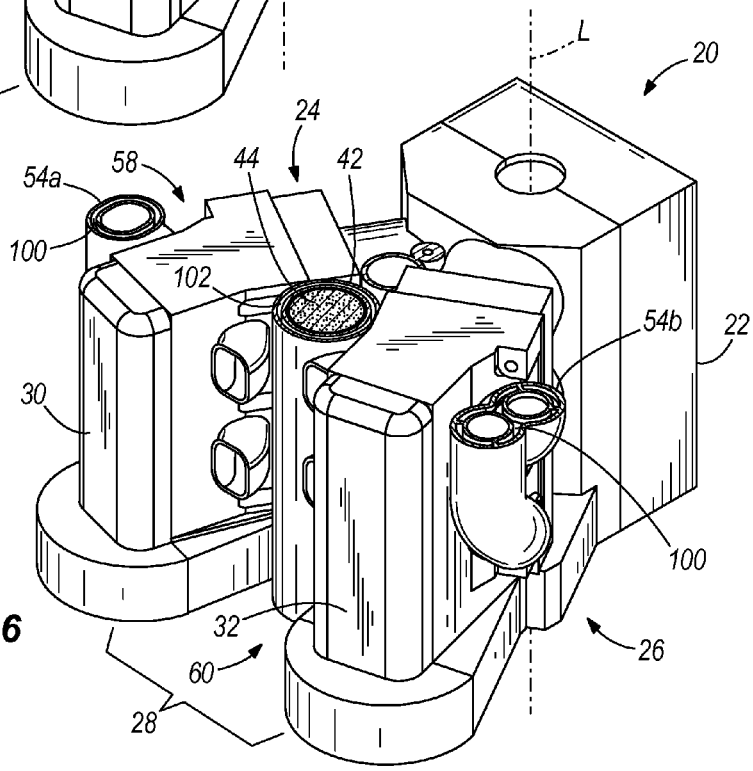
FIG. 6 is a view like FIG. 5, showing a catalyst receptacle disposed in the valley defined by the cylinders of the engine.

FIGS. 5 and 6 depict another example of the marine engine 20 having like reference numbers applied to like structures of the examples of FIGS. 1-4. In FIGS. 5 and 6, the outlet ports 46, 48 are outwardly oriented with respect to the valley 28. In this example, the conduit 50 has opposing 180 degree bends **54*a* extending inwardly from the first ports 46 to the catalyst receptacle 42 and opposing 180 degree bends 54*b* extending inwardly from the second ports 48 to the catalyst receptacle 42. Thus, the exhaust manifold 40 extends inwardly from the outwardly oriented first and second ports 46, 48 into only one of the first and second ends 58, 60 (in this case the first end 58). As such, the exhaust gas flows transversely from the outwardly oriented first and second ports 46, 48, through the conduits 50, reversing direction with respect to the longitudinal axis through the opposing 180 degree bends 54*a*, 54*b* and then into the first end 58 of the valley 28 to the catalyst receptacle 42, wherein the exhaust gas is treated by the catalyst 44. Again, by routing the exhaust gas through only a single 180 degree bend in the exhaust manifold 40 (i.e. bends 54*a* and 54*b* for each respective port 46, 48), the exhaust gas only reverses direction once with respect to the longitudinal axis and pressure drop is decreased and thus efficiency of the marine engine 20** is advantageously increased.

Figure 7:
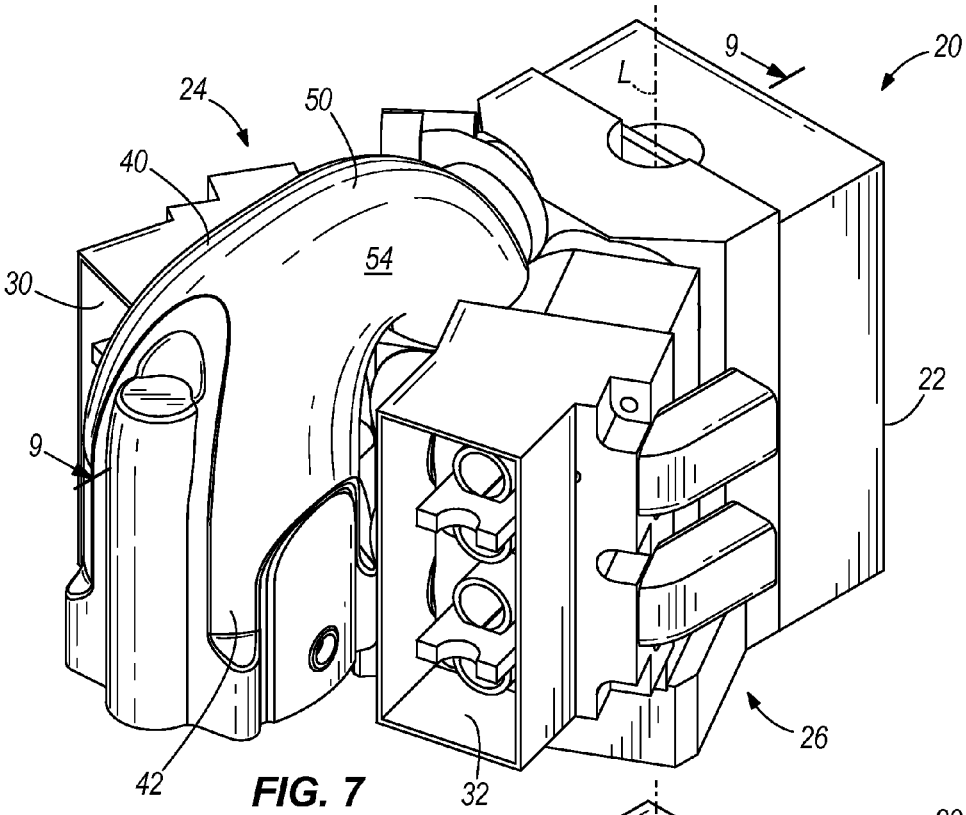
FIG. 7 is a perspective view of another example of a four cylinder, four stroke, V-style internal combustion engine for a marine drive.
Figure 8:
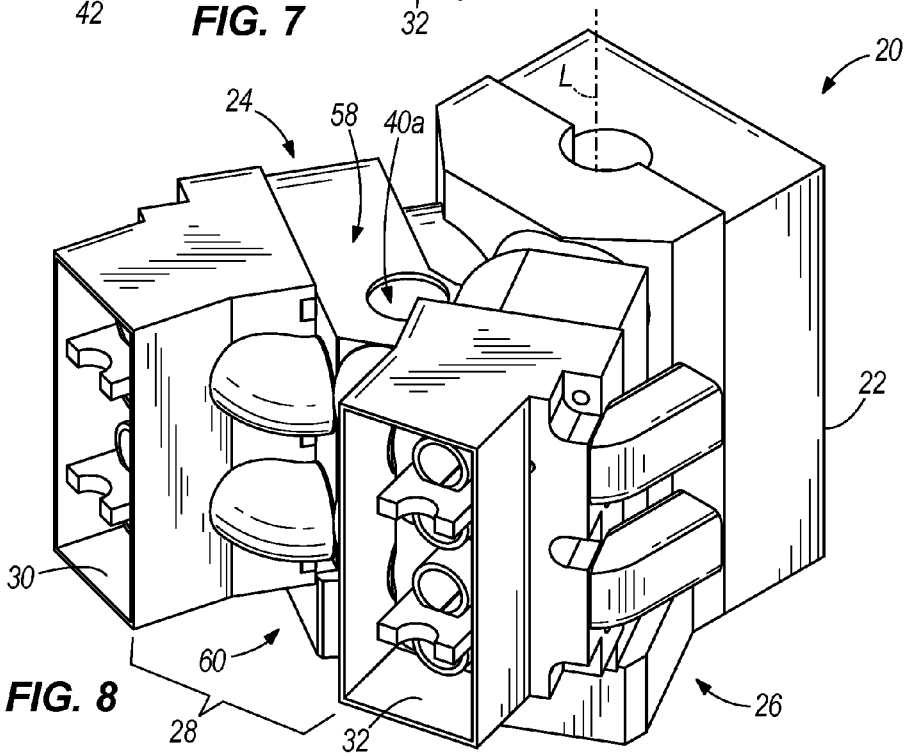
FIG. 8 is a view like FIG. 7, showing a catalyst receptacle disposed in the valley defined by the cylinders of the engine.
Figure 9:
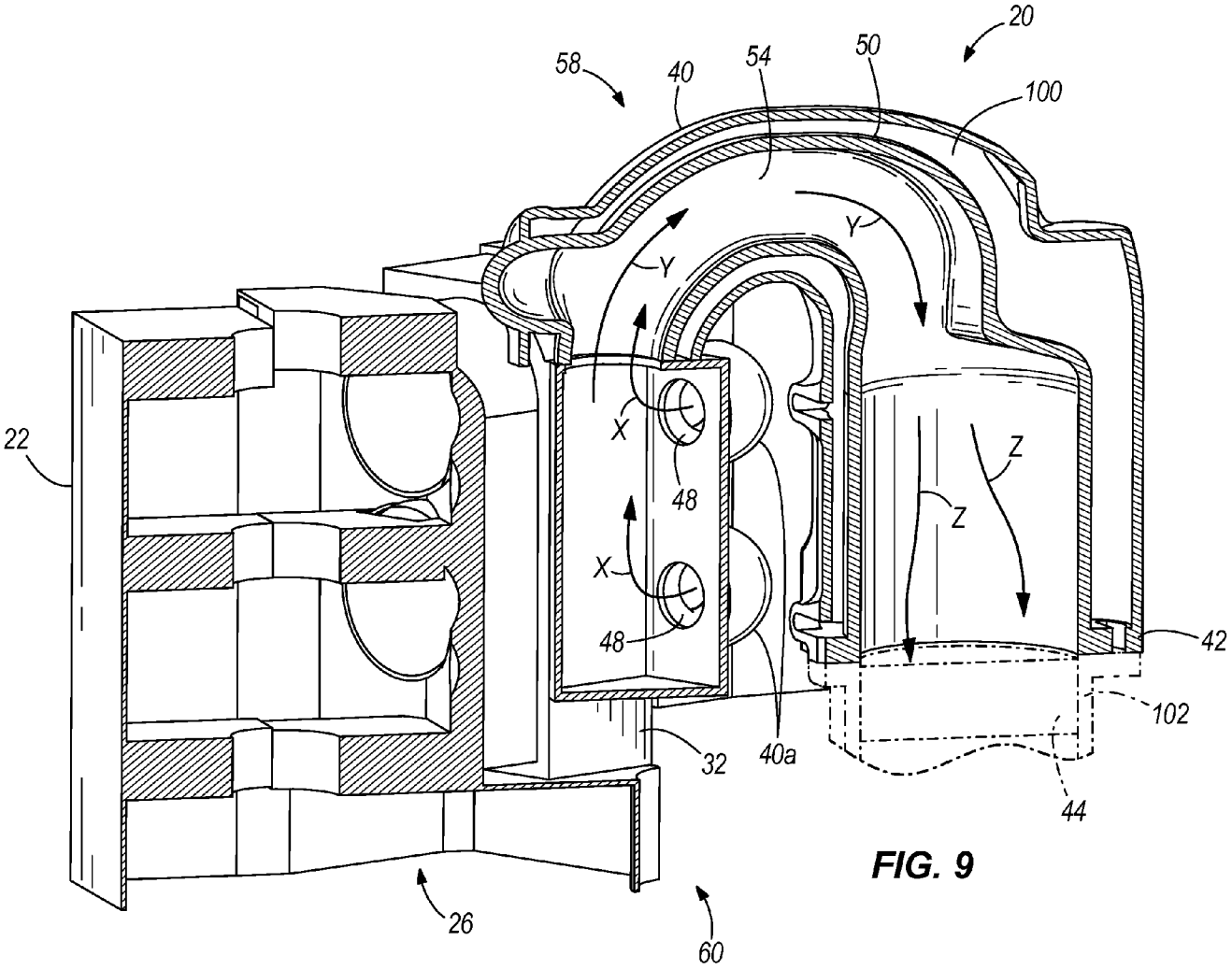
FIG. 9 is a view of section 9-9 taken in FIG. 7.

FIGS. 7-9 depict a marine engine 20 similar to the examples shown herein above, and having like reference numbers applied to similar structures. In FIGS. 7-9, the exhaust manifold 40 is located at the center of the valley 28 and has a portion **40*a* that is cast into the cylinder block 22. In this example, exhaust gas flows transversely from the first and second ports 46, 48, as shown in FIG. 9 at arrow X, through conduit 50 and reverses direction with respect to the longitudinal axis through the 180 degree bend 54, as shown at arrow Y, and then into the catalyst receptacle 42 located in the valley 28, as shown at arrow Z. The conduit 50** only reverses direction once with respect to the longitudinal axis L.

Figure 10:
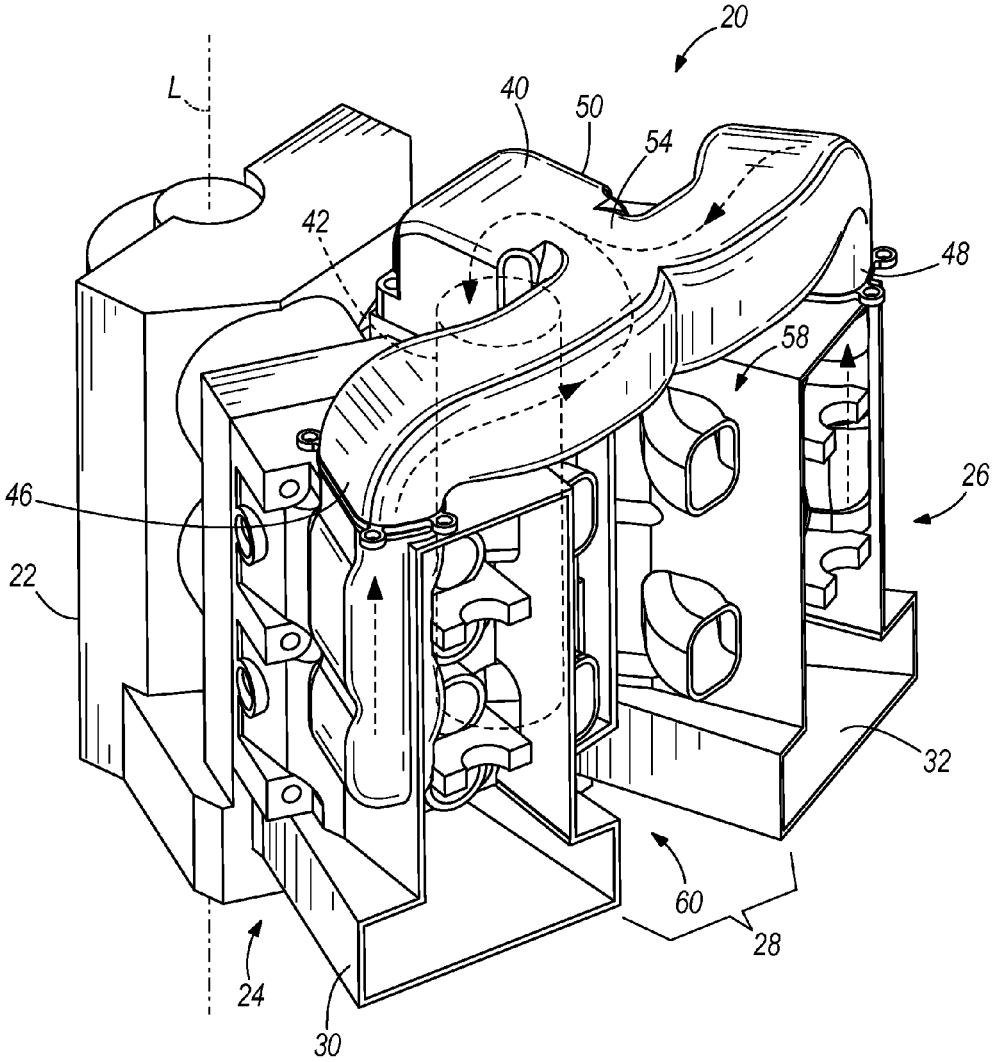
FIG. 10 is a perspective view of another example of a four cylinder, four stroke, V-style internal combustion engine for a marine drive.

FIG. 10 depicts a marine engine 20 similar to the examples shown herein above, and having like reference numbers applied to similar structures. In FIG. 10, the first and second ports 46, 48 include single ports 46, 48 located at one end of the first and second cylinder heads 30, 32. The catalyst receptacle 42 is cast into the cylinder block 22. Again, the conduit 50 only reverses direction once with respect to the longitudinal axis L.

The present disclosure thus provides a marine engine 20 having an exhaust system that comprises a catalyst receptacle 42 disposed in a valley 28 formed by the V-shape of first and second banks of aligned cylinders 24, 26. The catalyst receptacle 42 contains a catalyst 44 that treats exhaust gas from the first and second banks of cylinders 24, 26. An exhaust manifold 40 conveys exhaust gas from first and second cylinder heads 30, 32 to the catalyst receptacle 42. The exhaust manifold 40 has a first port 46 receiving exhaust gas from the first cylinder head 30, a second port 48 receiving exhaust gas from the second cylinder head 30, and a conduit 50 conveying the exhaust gas from the first and second ports 46, 48 to the catalyst receptacle 42. Exhaust gas thus flows from the first and second cylinder heads 30, 32 and transversely through the first and second ports 46, 48. Once into the exhaust manifold 40, exhaust gas flows transversely with respect to the first and second ports 46, 48, out of the valley 28, and through the conduit 50. Exhaust gas flows back into the first end 58 of the valley 28 and into the catalyst receptacle 42 for treatment by the catalyst 44.

What is claimed is:

1. A marine engine comprising:

a cylinder block comprising first and second banks of cylinders that are disposed along a longitudinal axis and extend transversely with respect to each other in a V-shape so as to define a valley there between;

a catalyst receptacle disposed in the valley and containing at least one catalyst that treats exhaust gas from the marine engine; and an exhaust manifold conveying exhaust gas from the marine engine to the catalyst receptacle, wherein the exhaust manifold has a first port receiving exhaust gas from the first bank of cylinders, a second port receiving exhaust gas from the second bank of cylinders, and a conduit conveying the exhaust gas from the first and second ports to the catalyst receptacle;

wherein from the first and second ports to the catalyst receptacle, the conduit only reverses direction once with respect to the longitudinal axis;

wherein the first and second ports are inwardly oriented towards the valley and wherein the exhaust manifold extends out from the valley and then back into the valley.

2. A marine engine according to claim 1, wherein the conduit comprises a 180 degree bend.

3. A marine engine according to claim 1, wherein the valley comprises first and second opposite ends with respect to the longitudinal axis and wherein the exhaust manifold extends out from and back into only one of the first and second ends.

4. A marine engine according to claim 3, wherein exhaust gas flows transversely from the first and second ports, through a 180 degree bend, and then into the catalyst receptacle.

5. A marine engine comprising:

a cylinder block comprising first and second banks of cylinders that are disposed along a longitudinal axis and extend transversely with respect to each other in a V-shape so as to define a valley there between;

a catalyst receptacle disposed in the valley and containing at least one catalyst that treats exhaust gas from the marine engine; and an exhaust manifold conveying exhaust gas from the marine engine to the catalyst receptacle, wherein the exhaust manifold has a first port receiving exhaust gas from the first bank of cylinders, a second port receiving exhaust gas from the second bank of cylinders, and a conduit conveying the exhaust gas from the first and second ports to the catalyst receptacle;

wherein from the first and second ports to the catalyst receptacle, the conduit only reverses direction once with respect to the longitudinal axis;

wherein the first and second ports are outwardly oriented with respect to the valley.

6. A marine engine according to claim 5, wherein the conduit comprises a 180 degree bend extending inwardly from the first port to the catalyst receptacle and a 180 degree bend extending inwardly from the second port to the catalyst receptacle.

7. A marine engine according to claim 5, wherein the valley comprises first and second opposite ends and wherein the exhaust manifold extends inwardly from the first and second ports into only one of the first and second ends.

8. A marine engine according to claim 7, wherein exhaust gas flows transversely from the first and second ports, through opposing 180 degree bends, and then into the catalyst receptacle.

9. A marine engine according to claim 1, wherein the exhaust manifold is located at the center of the valley.

10. A marine engine according to claim 9, wherein the exhaust manifold is cast into the cylinder block.

11. A marine engine according to claim 1, wherein the first and second ports communicate with first and second cylinder heads on the first and second banks of cylinders, respectively.

12. A marine engine according to claim 11, wherein the first and second ports are located at one end of the first and second cylinder heads with respect to the longitudinal axis.

13. In a marine engine comprising a cylinder block comprising first and second banks of cylinders that are disposed along a longitudinal axis and extend transversely with respect to each other in a V-shape so as to define a valley there between, and first and second cylinder heads on the respective first and second banks of aligned cylinders, an exhaust system comprising:

a catalyst receptacle disposed in the valley and containing at least one catalyst that treats exhaust gas from the first and second banks of cylinders; and an exhaust manifold conveying exhaust gas from the first and second banks of cylinders to the catalyst receptacle;

wherein the exhaust manifold has a first port receiving exhaust gas from the first bank of cylinders, a second port receiving exhaust gas from the second bank of cylinders, and a conduit conveying the exhaust gas from the first and second ports to the catalyst receptacle;

wherein from the first and second ports to the catalyst receptacle, the conduit only reverses direction once with respect to the longitudinal axis;

wherein the first and second ports are inwardly oriented with respect to the valley and wherein the exhaust manifold extends out from the valley and then back into the valley.

14. An exhaust system according to claim 13, wherein the conduit comprises a 180 degree bend extending from at least one of the first and second ports to the catalyst receptacle.

15. An exhaust system according to claim 14, wherein the valley comprises first and second opposite ends and wherein the exhaust manifold extends out from and back into only one of the first and second ends.

16. An exhaust system according to claim 15, wherein exhaust gas flows transversely from the first and second ports, through a 180 degree bend, and then into the catalyst receptacle.

17. In a marine engine comprising a cylinder block comprising first and second banks of cylinders that are disposed along a longitudinal axis and extend transversely with respect to each other in a V-shape so as to define a valley there between, and first and second cylinder heads on the respective first and second banks of aligned cylinders, an exhaust system comprising:

a catalyst receptacle disposed in the valley and containing at least one catalyst that treats exhaust gas from the first and second banks of cylinders; and an exhaust manifold conveying exhaust gas from the first and second banks of cylinders to the catalyst receptacle;

wherein the exhaust manifold has a first port receiving exhaust gas from the first bank of cylinders, a second port receiving exhaust gas from the second bank of cylinders, and a conduit conveying the exhaust gas from the first and second ports to the catalyst receptacle;

wherein from the first and second ports to the catalyst receptacle, the conduit only reverses direction once with respect to the longitudinal axis;

wherein the first and second ports are outwardly oriented with respect to the valley.

18. An exhaust system according to claim 17, wherein the conduit comprises a 180 degree bend extending inwardly from the first port to the catalyst receptacle and a 180 degree bend extending inwardly from the second port to the catalyst receptacle.

19. An exhaust system according to claim 17, wherein the valley comprises first and second opposite ends and wherein the exhaust manifold extends from both of the first and second ports into only one of the first and second ends.

20. An exhaust system according to claim 19, wherein exhaust gas flows transversely from the first and second ports through opposing 180 degree bends and then into the catalyst receptacle.

21. An exhaust system according to claim 13, wherein the first and second ports communicate with first and second cylinder heads on the first and second banks of cylinders, respectively.

22. An exhaust system according to claim 21, wherein the first and second ports are located at one end of the first and second cylinder heads with respect to the longitudinal axis.

* * * * *